United States Patent [19]

Rains et al.

[11] 4,192,507

[45] Mar. 11, 1980

[54] LIGHT ACTUATED SHOOTING ARCADE GAME

[75] Inventors: Lyle V. Rains, San Jose; Stephen D. Bristow, Los Altos Hills; Richard J. Patak, Cupertino, all of Calif.

[73] Assignee: Atari, Inc., Sunnyvale, Calif.

[21] Appl. No.: 966,429

[22] Filed: Dec. 4, 1978

Related U.S. Application Data

[63] Continuation of Ser. No. 813,807, Jul. 8, 1977, abandoned.

[51] Int. Cl.[2] ..... F41J 5/02; A63F 9/02

[52] U.S. Cl. ..... 273/311

[58] Field of Search ..... 35/25, 48 R; 273/101.1, 273/101.2, 102.2 R, 102.2 B, 102.2 S, 102.1 R, 105.1, 105.2, 1 ES, 185 A; 340/323 R

[56] References Cited

U.S. PATENT DOCUMENTS

| | | | |
|---|---|---|---|
| 2,181,948 | 12/1939 | McClellan | 273/101.1 |
| 2,269,256 | 1/1942 | Eakins | 273/101.1 |
| 2,934,634 | 4/1960 | Hellberg | 273/101.1 |
| 3,416,243 | 12/1968 | Greenberg | 35/48 R |
| 3,489,413 | 1/1970 | Groder et al. | 273/102.2 B |
| 3,549,147 | 12/1970 | Katter | 35/25 |
| 3,588,108 | 6/1971 | Ormiston | 273/101.1 |
| 3,627,323 | 12/1971 | Bozich | 273/102.2 S |
| 3,631,612 | 1/1972 | Westerberg | 35/48 R |
| 3,678,495 | 7/1972 | Gilbert | 340/323 R |
| 3,701,206 | 10/1972 | Ormiston | 273/101.1 X |
| 3,888,022 | 6/1975 | Pardes et al. | 35/25 |
| 3,960,380 | 6/1976 | Yokoi | 273/101.1 |
| 3,964,178 | 6/1976 | Marshall et al. | 273/101.1 |
| 4,006,907 | 2/1977 | Heffley, Jr. | 273/185 A |
| 4,035,933 | 7/1977 | Abe et al. | 35/48 R |
| 4,063,368 | 12/1977 | McFarland | 273/101.1 X |

*Primary Examiner*—Vance Y. Hum

*Attorney, Agent, or Firm*—Townsend and Townsend

[57] ABSTRACT

A shooting arcade game where several players each with a rifle may shoot at several common targets. A multiplexer provides for sequentially connecting a score display associated with each rifle to the targets the multiplexer also enabling the rifle only during the unique and dedicated time period that the associated score display is connected to the targets. An associated loudspeaker for each rifle is also provided.

1 Claim, 6 Drawing Figures

LIGHT ACTUATED SHOOTING ARCADE GAME

This is a continuation of application Ser. No. 813,807, filed July 8, 1977, now abandoned.

BACKGROUND OF THE INVENTION

The present invention is directed to a shooting arcade game and more specifically to one having a plurality of rifles with triggers actuated by several game players shooting at a common plurality of targets.

In a typical carnival type shooting arcade the players either shoot in rotation or separate targets are provided for each player in order that each player may be scored individually. Heretofore in games where a light beam is used either where the rifle produces the light beam and it is sensed by a photodetector or in a video type game where a spot of light is sensed by the pistol there is either only a single player, i.e., the players shoot in rotation, or no discrimination between the individual rifles as far as scoring.

OBJECTS AND SUMMARY OF THE INVENTION

It is, therefore, an object of the present invention to provide a shooting arcade game which provides for the automatic assignment of scores to a plurality of players effectively simulataneously shooting at a common plurality of targets.

In accordance with the above object there is provided a shooting arcade game having a plurality of rifles with triggers actuated by game players shooting at a common plurality of targets. A light source is affixed to each of the rifles and actuated by the trigger to produce a light flash. A photo-detector is included in each of the targets for sensing the light flash. A score display is provided for each of the rifles. Means electrically connect all of the photo-detectors to a common line and time multiplexing means connect the common line to each of the score displays for a unique and dedicated time period and also enable each of the light sources for actuation by an associated trigger for a unique and dedicated time period. This time period is at least partially concurrent with the time period of one predetermined score display.

DETAILED DESCRIPTION OF THE PREFERRED EMBODIMENTS

Figure 1:
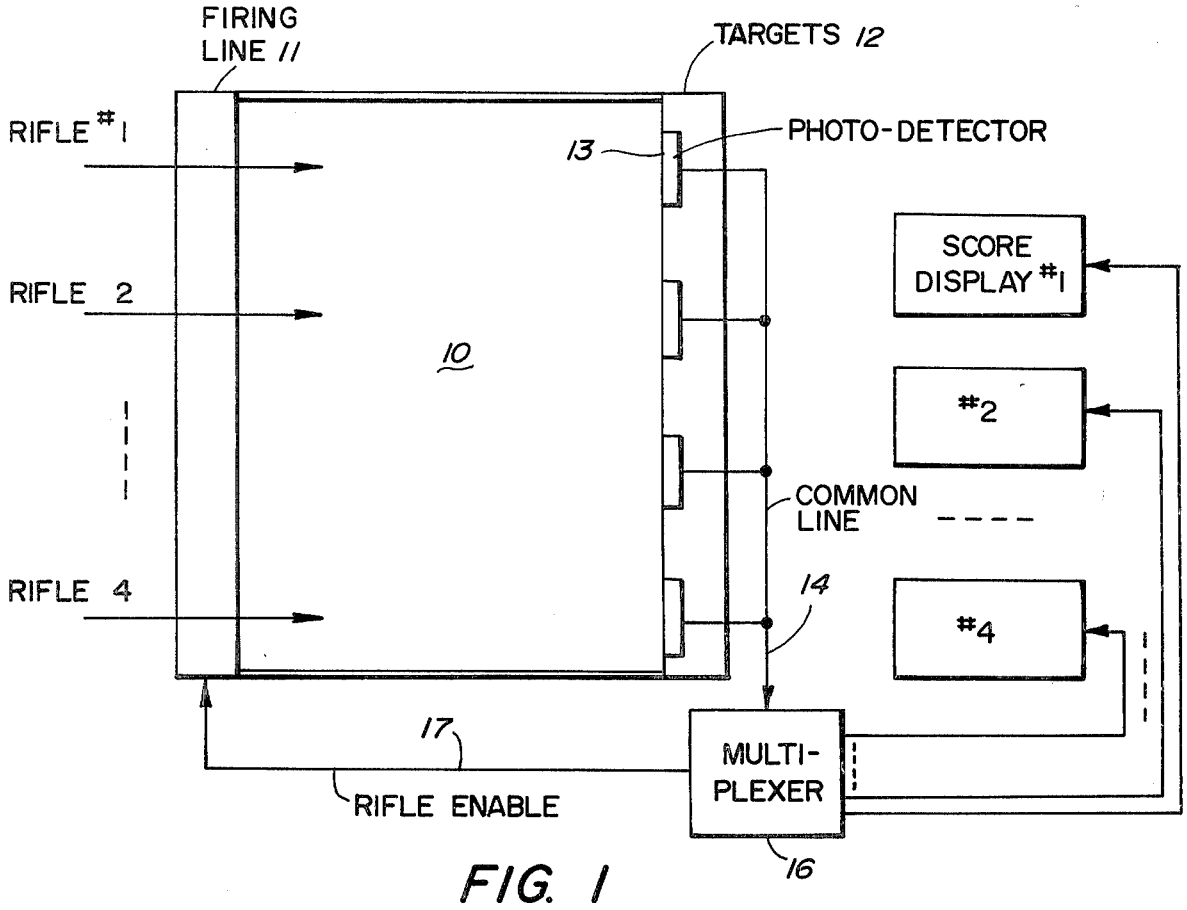
FIG. 1 is a simplified top view along with associated circuit block diagram of shooting arcade game embodying the present invention.

A shooting arcade 10 is illustrated in FIG. 1 in simplified format and includes a firing line 11 with targets 12. Firing line 11 has four rifles indicated numbered 1 through 4 which fire a light beam at targets 12 which include light responsive photodetectors 13. Photodetectors 13 are electrically connected together by common line 14 the common line being connected for a unique and dedicated time period to one of four score displays numbered 1 through 4 by a multiplexer 16. Multiplexer 16 also has a rifle enable output line 17 connected to the rifles at the firing line 11 to enable the associated trigger of each rifle for a unique and dedicated time period which is concurrent with the time period of its associated score display.

Each rifle has a xenon flash tube which can be activated by the trigger of the rifle when it is enabled. The eight possible players may fire at any of the common targets 12 only during each rifle's unique and dedicated time period. Since the score displays are synchronized or concurrent with the rifle enabling, only the score display associated with that rifle will be activated. Such activation may be merely a pulse on common line 14 to increment the score display one unit.

Figure 2:
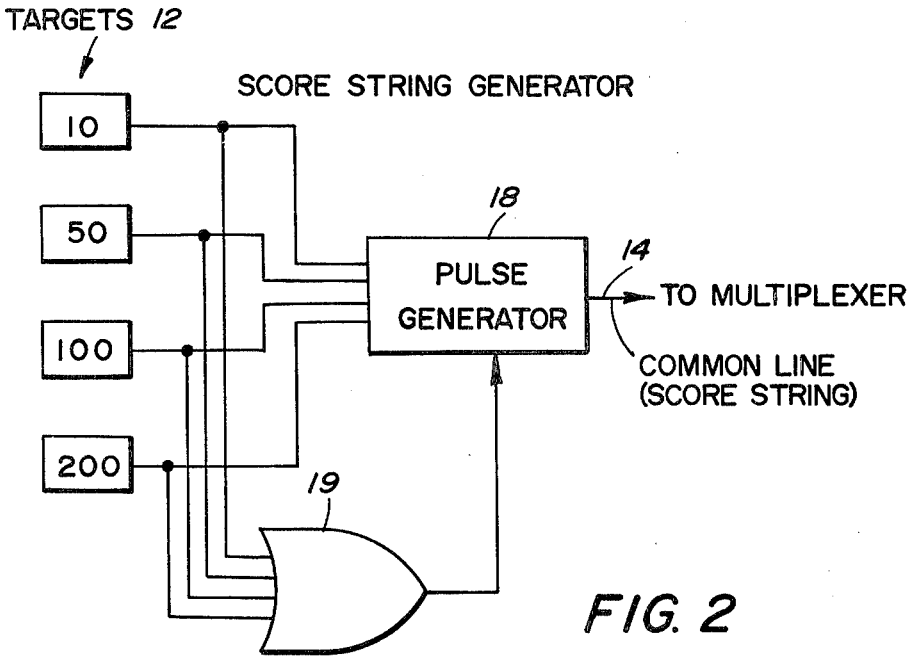
FIG. 2 is a more detailed block diagram of a portion of FIG. 1.

FIG. 2 illustrates a technique where targets 12 may have weighted values, for example, 10, 50, 100 and 200. Before being commoned on line or score string 14 individual targets or photodetectors are connected to a pulse generator 18 which in combination with the use of a common OR gate 19 provides a predetermined number sequence of pulses, for example, 1 through 20 during each unique and dedicated time period which increment the score display connected to the common line. Thus a "10" value target hit by the light beam will produce 1 pulse and a "200" target 20 pulses.

Figure 3:
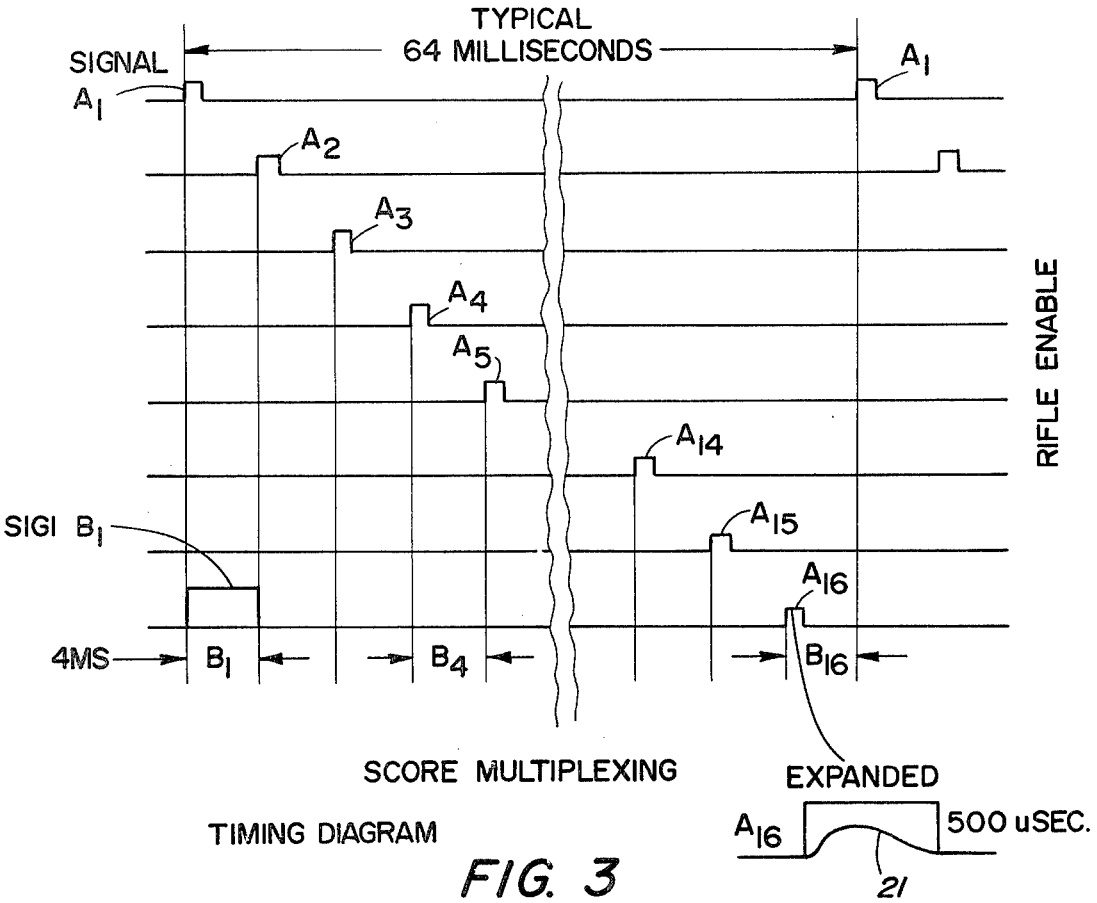
FIG. 3 is a timing diagram useful in understanding the present invention.
Figure 4:
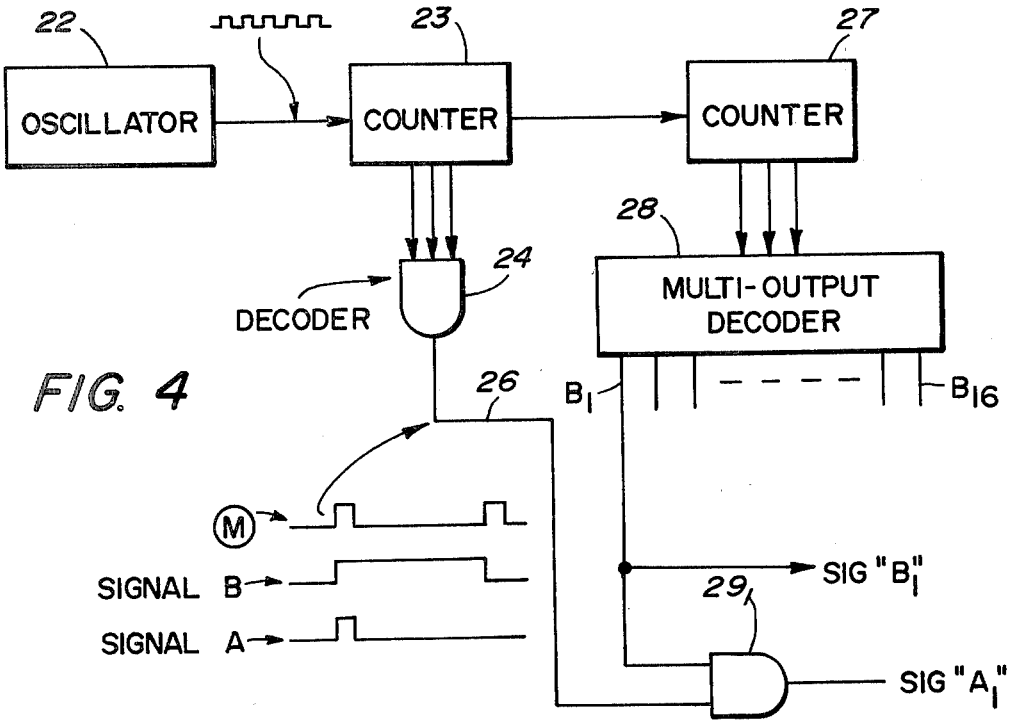
FIG. 4 is a more detailed block diagram of a portion of FIG. 1.

FIG. 3 is a timing diagram showing conceptually the operation of multiplexer 16. The rifle enable signals on line 17 are designated $A_1$ through $A_{16}$ which are the unique and dedicated time periods which allow the trigger to activate the rifles number 1 through number 4. The remaining 12 time periods $A_5$ through $A_{16}$, may be used for other rifles as will be described in conjunction with FIG. 6. The unique and dedicated time periods for the score displays are designated $B_1$ through $B_{16}$ and are at least partially concurrent with the rifle enable time periods. The typical time for the entire sequence is 64 milliseconds with each score time period "B" being therefore 1/16 or four milliseconds. An expanded version of the time period of signal $A_{16}$ is illustrated which is 500 microseconds in time and a typical xenon flash of the associated rifle is shown as the pulse 21 which has a typical duration of 400 microseconds. The actual timing pulses illustrated in FIG. 3 are generated by the circuit of FIG. 4. An oscillator 22 drives a counter 23 and outputs through an AND type decoder 24, pulses on line 26 designated M which are essentially a sequence of A-type pulses. The typical A-type and B-type waveform is illustrated in conjunction with line 26.

Counter 23 also drives a second counter 27 which is connected to a multi-output decoder 28 which has eight output lines each output line designated $B_1$ through $B_{16}$ which produce the associated signals shown in FIG. 3. The $B_1$ line, shown as producing signal $B_1$, is also connected to an AND gate $29_1$ which has the $B_1$ signal as one input and the M signal on line 26 as its other input to produce the signal $A_1$. Similar AND gates $29_2$ through $29_{16}$ are connected to the other B output lines of decoder 28 to provide signals $A_1$ through $A_{16}$.

Figure 5:
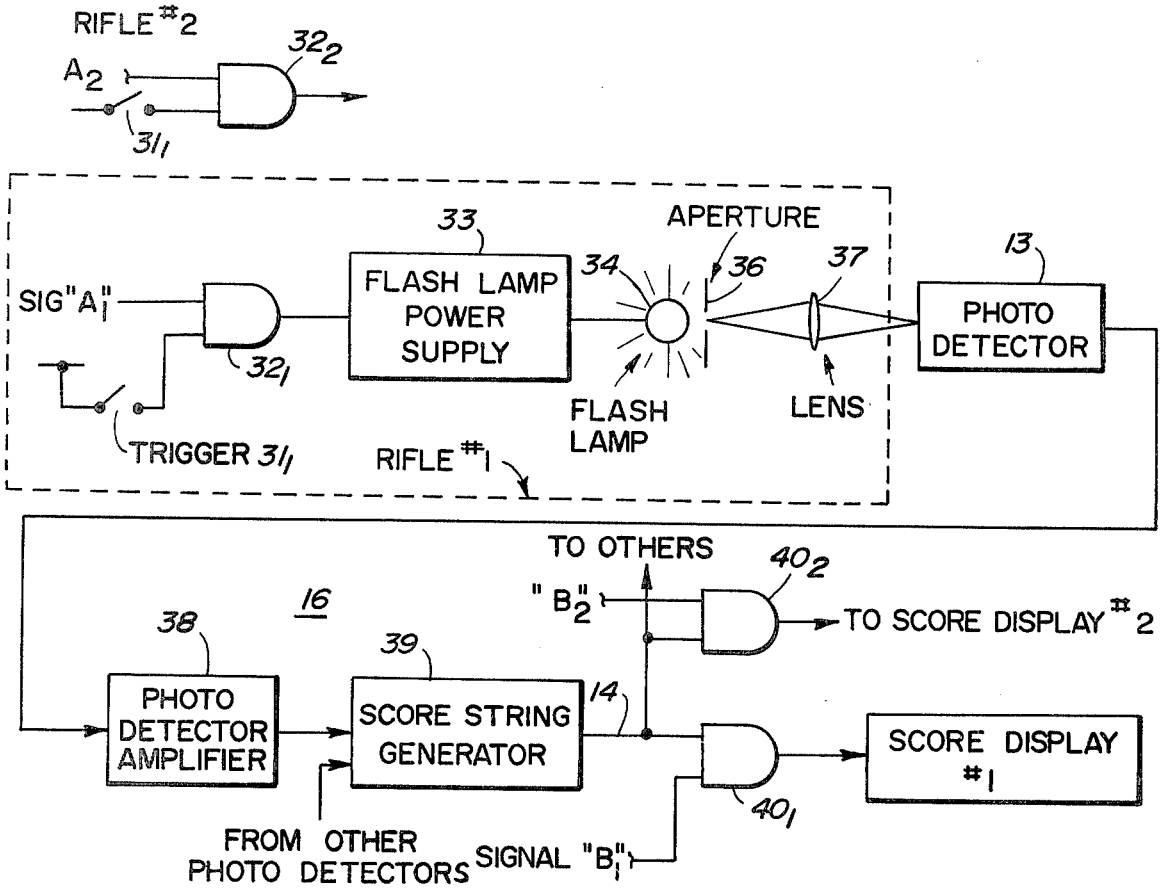
FIG. 5 is a more detailed block diagram of another portion of FIG. 1.

FIG. 5 shows the trigger $31_1$ of, for example, rifle number 1 which is one input to an AND gate $32_1$ which has as its other input the signal $A_1$. This drives a flash lamp power supply 33 associated with rifle number 1 which in turn activates xenon flash lamp 34. An appropriate aperture 35 provides for focusing of the beam in combination with the lens 37 and the light beam is then directed to a selected photodetector target 13. Rifle number 2 is partially illustrated with its AND gate $32_2$ having a trigger input $31_2$ and a signal $A_2$.

Figure 6:
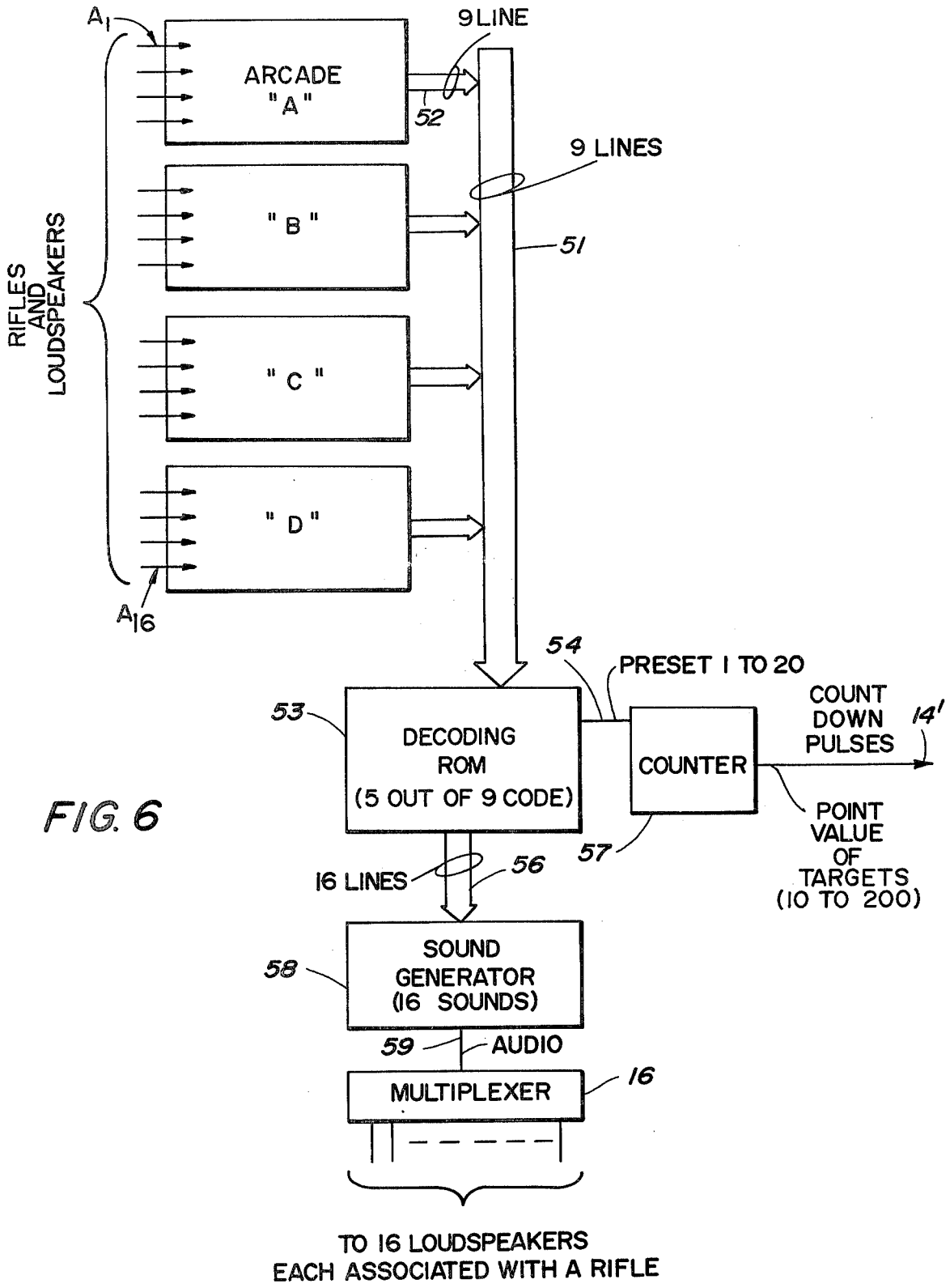
FIG. 6 is a block diagram of another embodiment of the invention.

The remainder of FIG. 5 illustrates a portion of multiplexer 16 as shown in FIG. 1. However, rather than the simplified showing of FIG. 1 each photodetector 13 is connected to an individual photodetector amplifier 38 and to the score string generator 39 which is illustrated in detail in FIG. 2. The multiplexing of the common line 14 is specifically achieved by a number of AND gates $40_1$ through $40_4$ which have the common line 14 as one input and as the other input the signals $B_1$ through $B_4$. Each AND gate 40 is connected to its corresponding score display.

Where a larger number of rifles is desired four arcades "A-D" can be provided as shown in FIG. 6. In order to reduce wiring from each target a 9 line bus 51 is connected to 9 line busses 52 from each arcade. The 9 line busses in turn are interfaced with the various photodetector targets of the arcade with a decoder (not shown) which converts a high target to a 5 bit code indicating both the value and type of target; i.e., duck, owl, tin can, etc. Each target may be conveniently connected to a photodetector matrix by fiber optic light guides. Such light guides may be constructed to have a relatively wide acceptance angle so that rifles from adjacent arcades will "hit" them.

Decoding ROM (read only memory) 53 senses the effective 5 out of 9 code on bus 51 and provide both point value information on line 54 and target type or sound commands on 16 line bus 56.

Specifically a counter 57 is preset 1 to 20 counts by line 54 and its count down pulses occur on score string line 14 to activate the proper score display via multiplexer 16. This is similar to the operation of FIG. 2. In addition a sound generator 58 generates on its audio output line 59 one of 16 different possible sounds corresponding to the type of target hit. This activates via multiplexer 16 a loudspeaker associated with the fired rifle.

The foregoing coding scheme also allows for error detections and protection against flash camera's, etc.

In summary the xenon flash tube of each rifle is enabled to flash only during a unique and dedicated time period. Each rifle is assigned a different time period and thus the rifles are allowed to fire in succession. However this is transparent to the user. Coincident or concurrent with each assigned time period the master score string is connected to the score display associated with the rifle. If the target is hit with a light beam of a particular rifle, a signal which represents the score of that particular target and its value is generated. In practice this is a sequence of pulses although an analog type circuit would be possible. The scoring signal is automatically routed to the particular score board or display associated with that rifle. In addition a sound connected with that target type or value is produced by a loudspeaker associated with the fired rifle.

What is claimed is:

1. A shooting arcade game having a plurality of rifles with triggers actuated by game players shooting at a common plurality of targets comprising: a light source adapted to be affixed to each of said rifles and to be actuated by said trigger to produce a light flash; a photo-detector for each of said targets, respectively, for sensing a light flash striking a target, each of the photodetectors and thereby its respective target being assigned a weighted scoring value at least one value being different from the other values; a score display for each of said rifles, respectively; a common electrical line; means for electrically connecting all of said photodetectors to said common line, said connecting means including a pulse generator responsive to the sensing of light by said photo-detectors and having output means for providing output pulses corresponding in number to the weighted scoring values of the photo-detectors; time multiplexing means for successively connecting said common line to said score displays for time periods which are unique to respective score displays and for successively enabling said light sources for time periods which are unique to respective guns and which are at least partially concurrent with the time periods of respective score displays.

* * * * *